US005127391A

United States Patent [19]

O'Keefe

[11] Patent Number: 5,127,391

[45] Date of Patent: Jul. 7, 1992

[54] TILE AND MARBLE CUTTING SAW APPARATUS AND METHOD

[76] Inventor: Kevin M. O'Keefe, 136 Rumford Ave., Mansfield, Mass. 02048

[21] Appl. No.: 550,144

[22] Filed: Jul. 9, 1990

Related U.S. Application Data

[63] Continuation-in-part of Ser. No. 305,415, Feb. 1, 1989, Pat. No. 4,940,038.

[51] Int. Cl.[5] ..... B28D 1/04

[52] U.S. Cl. ..... 125/13.01; 125/14; 51/166 TS

[58] Field of Search ..... 125/13.01, 14, 35; 51/166 TS, 166 TB, 72 L, 96, 99; 83/477.1, 477.2, 508.1, 508.2, 859

[56] References Cited

U.S. PATENT DOCUMENTS

| | | | |
|---|---|---|---|
| 2,705,005 | 3/1955 | Tuorto | 125/14 |
| 3,815,570 | 6/1974 | Story | 125/14 |
| 3,974,565 | 8/1976 | Ellis | 83/477.1 |
| 4,002,094 | 1/1977 | Erickson et al. | 83/477.1 |
| 4,412,401 | 11/1983 | Fundell | 51/99 |
| 4,428,159 | 1/1984 | Sigetich et al. | 51/99 |

*Primary Examiner*—M. Rachuba
*Attorney, Agent, or Firm*—Richard P. Crowley

[57] ABSTRACT

A marble and tile cutting apparatus and method wherein the apparatus comprises a support, a tray on the support moving between a cutting and a non-cutting position, the motor mounted on the support and rotary cutting blade driven by the motor to cut marble or tile material and wherein the improvement comprises a motor support wherein the motor may be moved laterally on the table support between preselected cutting positions and wherein the tray is characterized by a plurality of generally longitudinally preselected cutting grooves so as to permit the cutting blade to cut the marble or tile material in a cutting position with the grooves of the tray matching the preselected position of the transversely moveable molding and cutting blade for each particular cutting position.

9 Claims, 3 Drawing Sheets

TILE AND MARBLE CUTTING SAW APPARATUS AND METHOD

This is a continuation-in-part of Ser. No. 07/305,415, filed on Feb. 1, 1989, now U.S. Pat. No. 4,940,038.

BACKGROUND OF THE INVENTION

Masonry type saws typically containing circular saw blades are commonly used for cutting hard masonry type materials, such as slate, granite, tile, marble and the like. Such masonry saws typically comprises a fixed support, such as a table, a moveable tray on the table on which is placed the masonry material to be cut and also contains a motor and a circular saw, typically having a diamond blade, with the tray moveable between a cutting and a non-cutting position. Such masonry saws also include a reservoir pan located beneath saw blade for retaining cooling liquids which are generally used and pumped from and directed against the rotating circular saw blade to provide cooling and ease in cutting. A masonry saw apparatus is described for example in U.S. Pat. No. 3,635,206, issued Jan. 18, 1972, which provides for a reservoir pan and parallel in position with respect to circular saw blade. In addition, it is common practice to provide for a masonry type circular saw cutting apparatus to have the motor and saw blades adjustable longitudinally on the fixed table support with respect to the tray.

It is desirable to provide for a new and improved masonry saw apparatus and method whereby the saw apparatus may be rapidly and accurately adjusted for multiple cuts of masonry material, and wherein the saw may be rapidly adjusted to fit the size of the masonry material to be cut and wherein the depth of the table will allow complex cuts of masonry material to provide more maneuverability room near the saw blade and to overcome at least some of the disadvantages of the prior art masonry saw apparatus and methods.

SUMMARY OF THE INVENTION

The invention relates to an improved, adjustable masonry saw for the cutting of marble or tile or similar type material and to a method of cutting such masonry material.

An improved masonry saw apparatus has been discovered applicable for the cutting of hard masonry type materials, such as marble and tile, and suitable for rapid adjustment of the masonry saw blade to various positions which permits complex cuts to be made and provides greater depth and increased work surface, and wherein such adjustable saw blade apparatus provides for lateral movement and a quick, rapid adjustment and locking into position of the saw blade and motor to preselected transverse positions, providing for example multiple cuts on the masonry material on a moveable tray, such as for example to provide for three cuts of masonry material wherein the moveable tray has three selected multiple grooves in the tray and selected to fit in with the preselected positions of the laterally moveable saw blade and motor. In one preferred embodiment, the masonry saw apparatus provides for the lateral movement and rapid locking of the circular saw blade and motor on fixed table support in three preselected lateral positions and with the moveable tray containing three preselected grooves therein to fit each of the positions so that the operator may rapidly adjust saw blade before cutting of the masonry material in the desired position. Typically, the lateral movement of the motor and saw blades in the preselected grooves in the tray are selected to provide for a desired length and then a half a length and then a quarter of a length. Lateral movement of the circular saw blade and motor provides for an increased work surface on the masonry saw apparatus table work surface, and also permits complex cuts to be made in that the saw apparatus operator has more room near the saw.

The adjustable masonry cutting apparatus comprises in combination a fixed table support with a horizontal work surface having a longitudinal lateral axis therein, a tray means engaged on the horizontal surface; typically, said tray means longitudinally moveable between a saw cutting position wherein the masonry material supported on the tray means is cut as desired and a non-cutting position wherein the tray means is removed from the cutting blade, and a motor means mounted on the table support together with a rotary, typically circular, diamond cutting blade driven by the motor means so that the cutting blade is adapted to cut the selected masonry materials in the cutting position on the tray means. The masonry cutting apparatus includes means to move laterally on the table support, the motor means and the cutting blade therewith between multiple, preselected cutting positions for lateral movement and to lock the motor means and cutting blade into such preselected positions in a rapid and effective manner. In addition, the tray means is characterized by a plurality of generally longitudinal, preselected cutting grooves therein, so selected to permit the cutting blade to cut the masonry material, when the motor means and cutting blade are placed in any particular masonry cutting position, the grooves on the tray means matching the preselected positions of the motor and cutting blade for each particular preselected cutting position.

The invention provides a method of cutting masonry material, particularly marble and tile material, on a tray type work surface, typically a moveable work surface, which moves between a cutting and a non-cutting position and with the cutting done by a driven circular cutting blade and which method comprises providing preselected cutting positions for the cutting blade laterally across a table support and providing a tray work surface having a plurality of preselected cutting grooves therein. The grooves are preselected to conform to the position of the cutting blade in each preselected cutting position. The method includes selecting a particular cutting position for the cutting blade to cut masonry material and moving the tray work surface with the masonry material against a cutting blade to affect a cutting action, and thereafter, laterally moving the cutting blade to another preselected, laterally transverse, fixed work position after removal of the tray surface, and thereafter moving the tray surface of the masonry material to affect a cut in In a second preferred embodiment, the masonry saw apparatus provides for the lateral movement and quick tightening into a selected cutting position of the circular saw blade and motor on a fixed table support by providing an upper pair of spaced-apart rails extending downwardly from a movable mount platform including a first beveled rail and a second straight rail, and a cooperating lower pair of spaced-apart dove-tailed rails including a first dove-tail rail of greater width and thickness and a second dove-tailed rail extending upwardly from a pivot plate shelf which is free to pivot about the axis of one end but fixed relative to any lateral movement and including a clamping bar, tightening blocks and threaded tightening screws. The clamping bar having a beveled surface and a straight surface, typically being positioned between the stationary lower first dove-tail rail and the movable straight upper rail, and being attached to the straight upper rail by threaded screws extending through spaced-apart apertures at right angles to the first rail surface. Upon tightening the threaded screws move the clamping bar against the lower dove-tail so that the position of the motor mount is fixed relative to the fixed rail. Furthermore in a preferred construction a nylon wear strip provides a close fit between the movable motor mount platform and the fixed pivot plate shelf, wherein the upper beveled rail fits with the lower dove-tail to keep the motor and saw blade in perpendicular relationship to movement of the motor mount platform.

The invention will be described for the purposes of illustration only in connection with certain embodiments; however, it is recognized that those persons skilled in the art may make various modifications, changes, additions, deletions and improvements to the masonry saw apparatus and method as described herein, all without departing from the spirit and scope of the invention.

DESCRIPTION OF THE EMBODIMENTS

Figure 1:
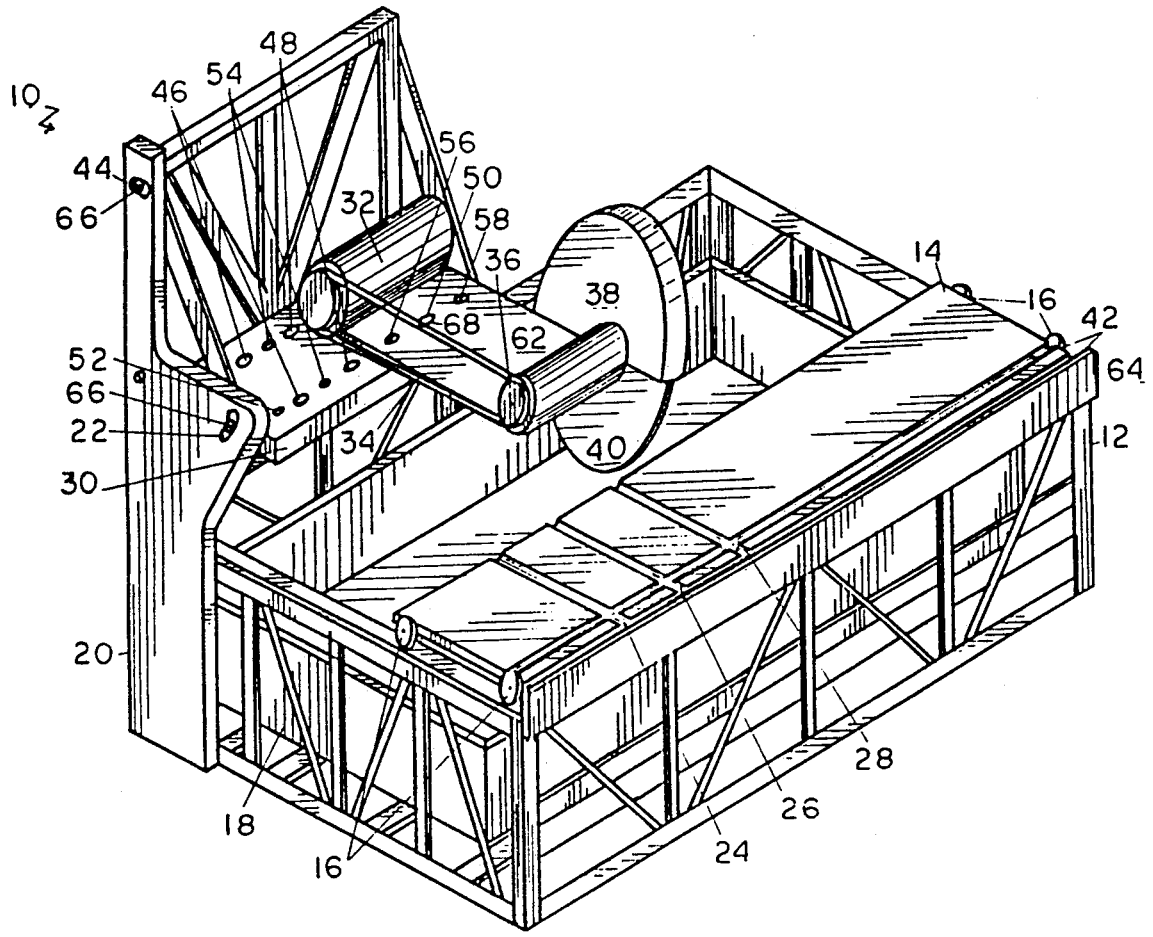
FIG. 1 is a perspective view from above of a masonry saw cutting apparatus of the invention.
Figure 2:
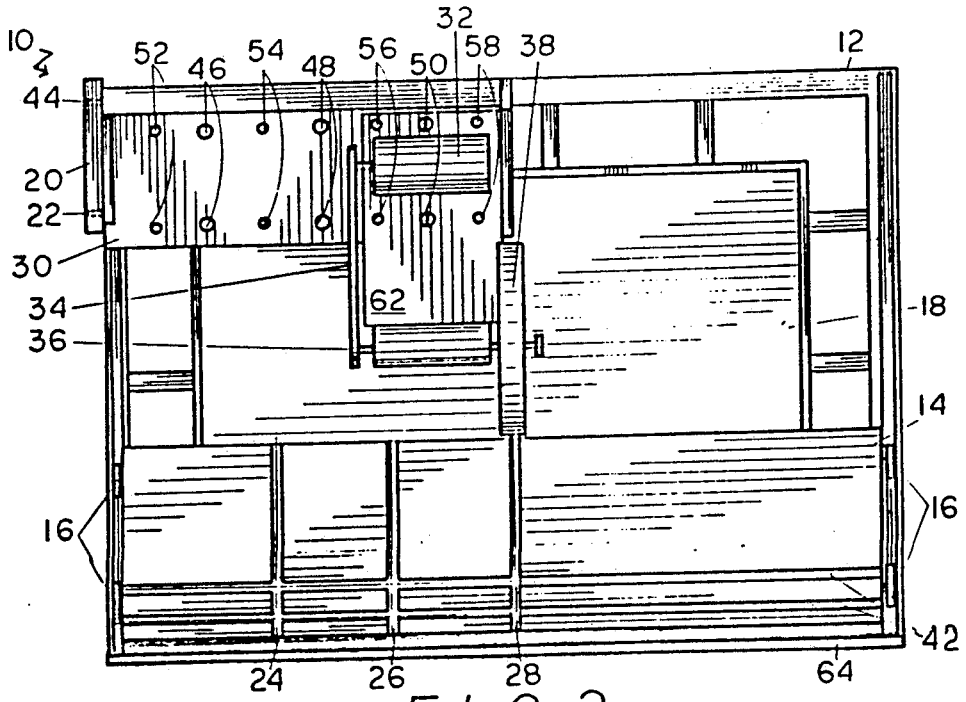
FIG. 2 is a top plan view of the masonry saw apparatus of FIG. 1.

The drawings show a masonry cutting apparatus 10 which includes a fixed table support 12 which table support contains thereon a moveable tray 14 having a work surface, which tray is moveable on wheels 16 at each end thereon and grooves on the table support between a cutting position and a non-cutting position with the table shown in a non-cutting position. The apparatus 10 includes a reservoir pan 18 beneath the tray 14 which serves as a reservoir for sawdust sludge and is a source of circulating cooling fluid to be pumped against the saw blade and masonry work piece on the support surface of the tray 14. The apparatus 10 includes an outer side support 20 having a slotted opening 22 therein and another slotted opening 44 therein at the upper level thereof, thus secured by bolts and pivot pin 66 to a motor shelf support 30, which supports a motor, which motor is adapted to drive a pulley 34 through a bearing 36 to drive a diamond cutting wheel selected to cut the masonry 40 and having a blade guard 38. The tray 14 is characterized by a plurality of preselected, longitudinal grooves in the surface 24, 26, and 28 at sufficient depth to permit a masonry material thereon to be cut by the circular cutting blade 40. The tray 14 also includes a pair of spaced apart, parallel, transverse grooves 42 which are employed for the use of various accessories such as protactor and fixed 45° jig, for example, a masonry material stop, illustrated as 64 and shown as clipped into the forward groove 42. The motor shelf support 30, which is adjustable and which is secured to the side support 20, is adjustable in position through adjusting and tightening bolts through slots 44 and 22 and pivoting on pivot pin 66, contains in the surface thereon a plurality of preselected holes 46, 48 and 50 which are locator holes and a plurality of motor support holes 52, 54, 56 and 58. The motor 32 is adjustable for lateral movement along the shelf 30 together with the pulley 34, the bearing 36, the blade 40 and the guard 38 at preselected locations. As illustrated, the motor is shown parallel with a non-cutting position, for example, with a tray 32 inches in width. The first groove 24 would represent one-half of that width or 16 inches, the next groove 26 representing 8 inches and the next groove 28 representing 4 inches thereby providing for the ability for a masonry material on the work surface of the tray 14 to cut a piece 32 inches in width.

As illustrated, lateral movement of the motor and saw blade is placed in a preselected, three multiple cuts, which preselected positions match the longitudinal grooves 24, 26 and 28 on tray 14. As illustrated, holes 46, 48 and 50 contain locator pins, which pins locate the motor in the defined position on the motor support shelf 30, while 58 and 60 are the tops of threaded bolts which are used to secure the motor securely in position. When lateral movement of the motor is desired to a new position, the bolts loosened and the motor then moved laterally, for example to locator positions 48 where the pins are dropped in to hold the motor in position and then bolts are threaded into positions 56 and 58 to fix the motor in position for the cutting blade to move through groove 26. Thus, by lateral movement of the motor 32 and saw blade 40 together with the preselection of the longitudinal grooves 24, 26 and 28 and tray 14, masonry material, such as marble or tile, may be rapidly cut to desired shapes, and on movement of the moveable tray 14 forward into the cutting position so that the saw blade 40 cuts the material into the selected groove. The lateral movement of the motor and saw blade through the part 62 provides for rapid and accurate location of the motor in a position through the locator pin and then permits the motor to be securely fastened in the newly located position.

In operation, the motor 32 and shelf 62 with bearing 36, pulley 34 and blade 40 are positioned as desired by tightening the screws in adjustable slots 22 and 44 and then moving the motor into position to the locator pins 50 secured to the shelf 30 through bolts 56 and 58. As illustrated, the masonry material is placed on the surface top of the tray 14 at the desired position, typically against a removable, snap in stop 64 in groove 42, the tray moves longitudinally forward toward the cutting blade 40 to permit the required cut. Thereafter, the motor is moved laterally to a new position through the threading of the bolts 56 and 58, loosening them and lifting up the locator pins and moving the motor laterally on the shelf 30, inserting the new locator pins in the locator holes 48 or 46 and securely bolting the motor into the new location together with the blade which is then prepositioned in the new longitudinal groove 26 or 28 of the tray 14.

Figure 3:
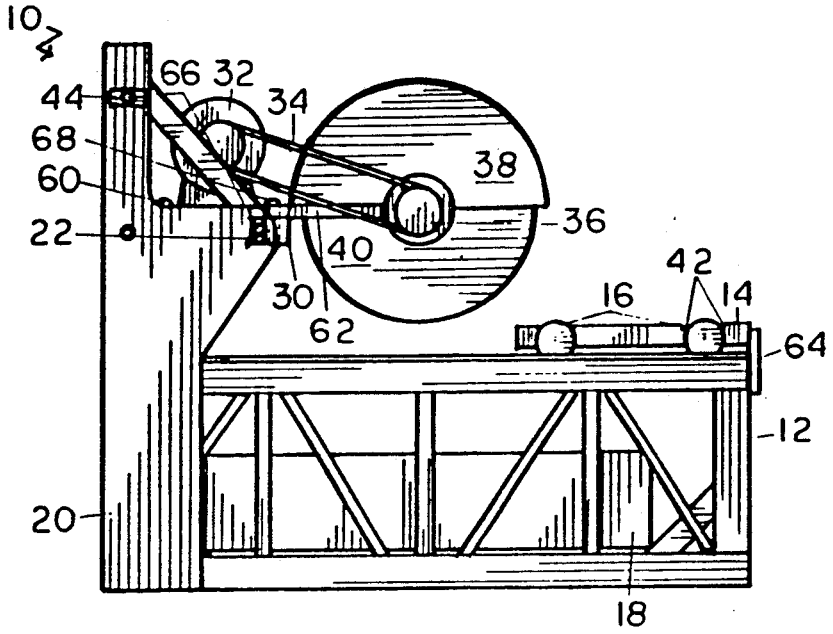
FIG. 3 is a side plan view of the masonry saw apparatus of FIG. 1.
Figure 4:
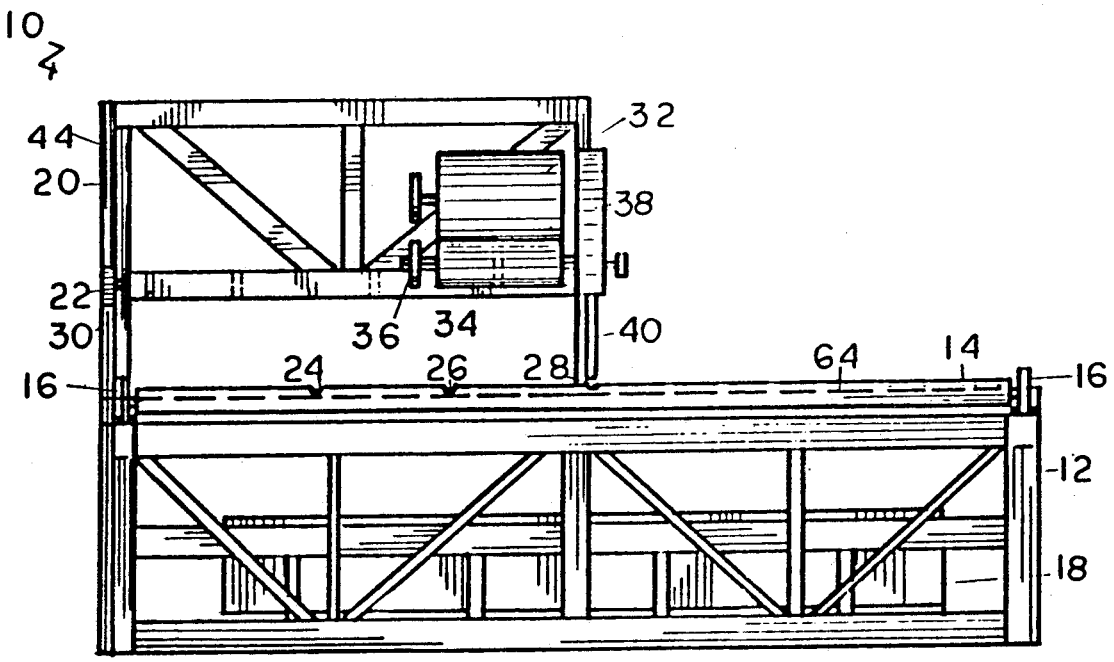
FIG. 4 is a front plan view of the masonry saw apparatus of FIG. 1.
Figure 5:
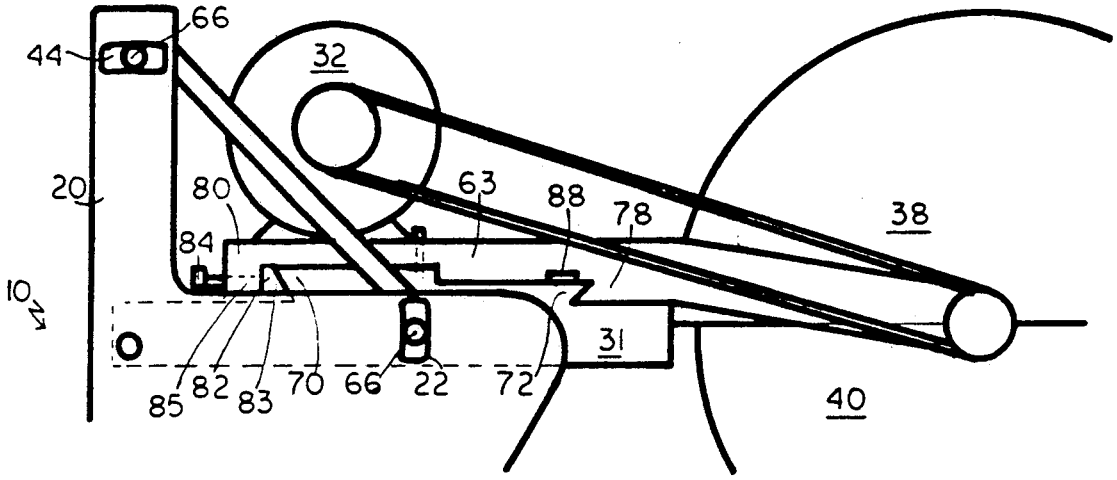
FIG. 5 is an exploded side plan view of the masonry saw apparatus of the second preferred embodiment of the invention otherwise as shown in FIG. 3.
Figure 6:
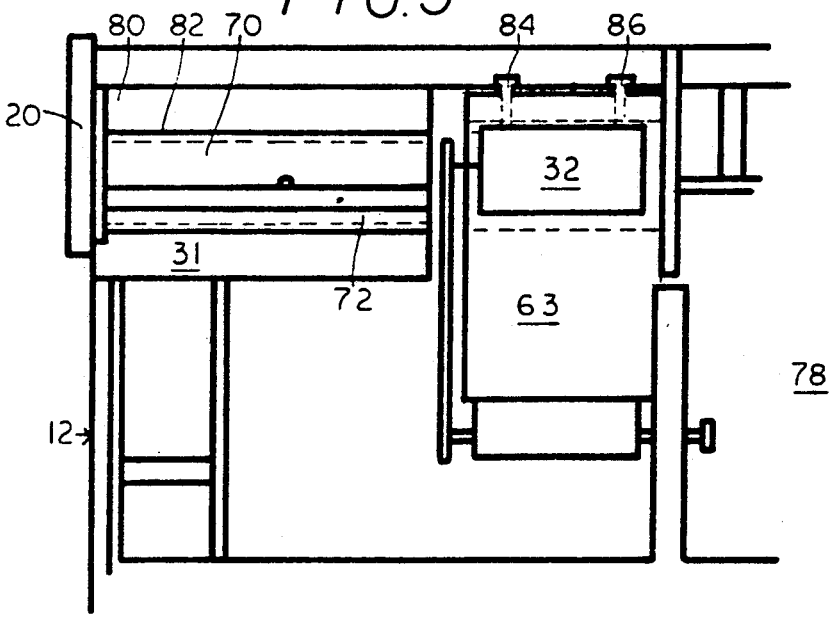
FIG. 6 is a partial top plan view of the masonry saw apparatus of the second preferred embodiment of the invention otherwise as shown in FIG. 2.

As illustrated in FIGS. 5 and 6, the masonry cutting apparatus 10 includes an alternate second embodiment including a horizontally extending fixed pivot plate shelf 31 including a pair of lower spaced-apart dove-tail rails 70 and 72 and a movable motor mount platform 63 with a pair of upper rails 78 and 80 positioned for lateral movement of the motor 32 and saw blade 40 between a first selected cutting position and a second selected cutting position. The fixed pivot plate shelf 31 as shown in FIG. 3 and the movable platform 63 are mounted in parallel relationship with the longitudinal axis of tray 14, with the pivot plate shelf 31 being mounted on pins 66 and bolts extending through slots 22 and 44 in the generally vertical outside support 20. Pivot plate shelf 31 while being fixed in relation to movement along the lateral axis of the fixed table support 12, as shown in FIG. 1, the pivot plate 31 is pivotably mounted to rotate about the axis of pin 66 for movement of the saw blade 40 between a non-cutting position and a cutting position shown in FIG. 3. The pair of lower dove-tailed rails 70 and 72 are spaced-apart and positioned in parallel relationship extending along the lateral axis of, and affixed to pivot plate shelf 31. The movable shelf 63 is slideably mounted on pivot plate 31 by means of the upper rails 78 and 80 being spaced apart and having different thicknesses, cooperating with the lower dove-tail rails 70 and 72. The upper rails include the rail 78 which is beveled and the rail 80 which is straight positioned in parallel relationship extending along the lateral axis of and affixed to the platform 63, the upper rails 78 and 80 cooperating with the lower dove-tailed rails 70 and 72 for slideable movement of the motor base platform 63 with respect to pivot plate shelf 31, the straight rail 80 being characterized by a pair of threaded apertures adapted to cooperate with an elongated clamping bar 82 and includes threaded screws 84 and 86. The clamping bar 82 has a beveled surface 83 and a straight surface 85 is disposed intermediate to the straight rail 80 of the movable platform 63 and the beveled dove-tailed rail 70 of the fixed pivot plate shelf 31, for movement responsive to operating the threaded screws 84 and 86 between a release position with the beveled surface 83 spaced from dove-tail 70 and a clamped or tightened position with the beveled surface 83 in tightened engagement with dove-tail 70. A wear strip 88 typically a nylon strip is provided adjacent and parallel to the second upper dove-tail for improved sliding movement of the platform 31.

What is claimed is:

1. A masonry cutting apparatus, which apparatus comprises in combination;

(a) a table support with a horizontal surface having a longitudinal and lateral axis;

(b) a tray means on the horizontal surface of the table support, the tray means longitudinally movable between a masonry cutting position wherein the masonry on the tray is cut, and a masonry non-cutting position;

(c) a motor means;

(d) a circular blade cutting means driven by the motor means, the circular blade cutting means adapted to cut masonry in a cutting position;

(e) a shelf support means to support the motor means and the cutting blade means and to permit the rapid lateral movement of the motor means and the cutting blade means between selected fixed masonry cutting positions, which shelf support means comprises:

(i) an extended shelf above the surface of the table support;

(ii) a laterally movable platform on which the motor means and cutting blade means are mounted, the platform mounted for lateral slideable movement on the shelf between selected masonry cutting positions;

(iii) the extended shelf having a pair of spaced apart first and second rails on the upper surface;

(iv) the platform having lower first and second spaced apart rails to be placed in a cooperative lateral sliding relationship with the first and second upper rails; and (v) means to tighten the upper and lower rails to move between a tightened position to place the motor means and cutting blade means in a selected cutting blade position and a release position for the release of the tightened position so that the platform with the motor means and cutting blade means may be laterally moved to another cutting blade position.

2. The masonry apparatus of claim 1 wherein the means to tighten comprises a plurality of screw means each screw means connected to a beveled clamping bar adjacent a first lower rail to move the clamping bar between a tightened position and a released position, the screw means to be placed in tapped apertures extending through the first upper rail in a longitudinal direction parallel to the longitudinal axis of the support table.

3. The masonry apparatus of claim 2 wherein the beveled clamping bar is slideably positioned between a first upper dove-tailed rail and a first lower straight rail in parallel relationship thereto in cooperation with threaded screw means extending through apertures provided in the straight rail in perpendicular relationship thereto, the clamping bar comprising a beveled surface for engaging the first dove-tail rail and a straight surface for engaging the straight rail.

4. The masonry apparatus of claim 1 wherein the means to tighten comprises threaded means extending through the first lower rail to place the first lower rail in a tightened position against the first upper rails.

5. The masonry apparatus of claim 1 wherein the first and second lower rails comprise a dove-tail rail and a straight rail and which masonry apparatus includes a clamping bar having a beveled surface and a straight surface and positioned cooperatively between the upper straight bar rail and lower first dove-tail rail and the means to tighten is adapted to move the clamping bar against the first lower dove-tail rail to place the platform in a selected tightened position.

6. The masonry apparatus of claim 5 wherein the lower straight rail has a plurality of apertures therein, and the means to tighten includes a plurality of threaded screws extending through the apertures and secured to the clamping bar to permit threaded movement of the clamping bar into tightened and release positions.

7. The masonry apparatus of claim 1 wherein the first and second upper rails are dove-tail rails.

8. The masonry apparatus of claim 1 which includes a wear strip generally adjacent and parallel to the second upper dove-tail tail to improve the sliding movement of the platform.

9. The masonry cutting apparatus which apparatus comprises in combination;

(a) a table support with horizontal surface having a longitudinal and lateral axis;

(b) a tray means on the horizontal surface of the table support, the tray means longitudinally movable between a masonry cutting position wherein the masonry on the tray is cut, and a masonry non-cutting position;

(c) a motor means;

(d) a circular blade cutting means driven by a motor means, the circular blade cutting means adapted to cut masonry in a cutting position, a shelf support means to support the motor means and the cutting blade means;

(e) platform means on which the motor means and the cutting blade means are secured, the platform slideably and laterally movable on the shelf support means between selected masonry cutting positions;

(f) threaded means comprising a plurality of threaded screw means and a beveled clamping bar, the threaded means extending through the straight rail to secure by threaded movement of the clamping bar the located motor means and cutting blade means in the selected cutting blade position and to permit the release of the threaded means; and (g) the tray means characterized by;

(i) a plurality of generally longitudinally preselected cutting grooves placed therein in preselected positions to permit the cutting blade means to cut the masonry in preselected located and secured cutting positions.

* * * * *